United States Patent [19]

Jundt et al.

[11] Patent Number: 4,831,992

[45] Date of Patent: May 23, 1989

[54] METHOD FOR COMPENSATING FOR A TANK VENTING ERROR IN AN ADAPTIVE LEARNING SYSTEM FOR METERING FUEL AND APPARATUS THEREFOR

[75] Inventors: Werner Jundt, Ludwigsburg; Harald Krempel, Schwieberdingen; Rudolf Moz, Möglingen, all of Fed. Rep. of Germany

[73] Assignee: Robert Bosch GmbH, Stuttgart, Fed. Rep. of Germany

[21] Appl. No.: 123,147

[22] Filed: Nov. 20, 1987

[30] Foreign Application Priority Data

Nov. 22, 1986 [DE] Fed. Rep. of Germany ..... 3639946

[51] Int. Cl.[4] ..... F02B 33/00

[52] U.S. Cl. ..... 123/520

[58] Field of Search ..... 123/486, 489, 516, 518, 123/520, 517, 519

[56] References Cited

U.S. PATENT DOCUMENTS

| | | | |
|---|---|---|---|
| 4,377,142 | 3/1983 | Oosuka et al. | 123/520 |
| 4,641,623 | 2/1987 | Hamburg | 123/520 |
| 4,664,087 | 5/1987 | Hamburg | 123/520 |
| 4,677,956 | 7/1987 | Hamburg | 123/520 |
| 4,683,861 | 8/1987 | Breitkreuz et al. | 123/520 |
| 4,700,683 | 10/1987 | Urazaishi et al. | 123/520 |
| 4,741,317 | 5/1988 | Yost | 123/520 |
| 4,741,318 | 5/1988 | Korge et al. | 123/520 |

*Primary Examiner*—Raymond A. Nelli

*Attorney, Agent, or Firm*—Walter Ottesen

[57] ABSTRACT

The invention is directed to a method for compensating for the tank venting error in a learning fuel metering system metering the required fuel quantity to an internal combustion engine. The method includes carrying out the lambda correction with adaptively learned precontrol values also in phases of the tank venting so that the disturbing quantities which are introduced by the tank venting can likewise be learned out; however, the obtained learn values are entered in separate memory locations dependent upon whether they have been determined during the basic adaptation or during the adaptation with tank venting. These learn values are switched to the lambda control as precontrol corrective values in accordance with the time control determining the sequence of the base adaptation phases and tank venting adaptation phases. The invention is also directed to an apparatus for carrying out the steps of the method of the invention.

7 Claims, 3 Drawing Sheets

Flow Diagram showing the Basic Adaptation Phase (I) and the Tank Ventilation Phase (I')

Phase Change Diagram Indicating the Change from Basic Adaptation Phase to Tank Ventilation Phase

METHOD FOR COMPENSATING FOR A TANK VENTING ERROR IN AN ADAPTIVE LEARNING SYSTEM FOR METERING FUEL AND APPARATUS THEREFOR

FIELD OF THE INVENTION

The invention relates to a method for compensating for a tank venting error in an adaptive learning system for metering the required fuel quantity to an internal combustion engine. In this method, the fuel quantity is determined by means of a control wherein an actual value is evaluated (lambda control) as well as by taking precontrol quantities as a basis which are at least partially corrected by means of an adaptive learning process and wherein a regenerating fuel flow is supplied to the intake region of the engine supplementary to the fuel quantity. The regenerating fuel flow is from an intermediate container (active charcoal filter) which takes up fuel vapor from the tank.

BACKGROUND OF THE INVENTION

For internal combustion engines, it is known not to vent fuel vapors to the ambient. These fuel vapors are formed in dependence upon specific parameters such as fuel temperature, fuel quantity, vapor pressure, air pressure, scavenging quantity and the like. Instead, it is preferable to pass the fuel vapors to the engine via an intermediate container filled with active charcoal. The active charcoal container receives the fuel vapors formed in the tank such as in a stationary vehicle. The active charcoal container is then usually connected via a line with the intake region of the engine and therefore passes fuel to the engine in addition to the fuel metered to the engine by the fuel metering system. This system determines the particular quantity of fuel required for the operation of the engine while considering specific operating characteristic quantities.

In this connection, it is also known to prevent an increase of the exhaust emissions or to hold the latter to low values in that the tank venting (TE) is only permitted for specific operating conditions of the engine. With respect to the foregoing, reference may be made to the publication of Robert Bosch GmbH entitled "Motronic - Technische Beschreibung" C5/1, Aug. 1981 and German published patent application DE-OS No. 28 29 958. The above-mentioned increase of the exhaust emissions is brought about by such an additional fuel-air mixture quantity caused by the venting of the tank.

The intermediate storage container containing the active charcoal filter can store fuel vapors up to a predetermined maximum quantity with a scavenging or regeneration of the filter occurring during operation of the engine by means o the under pressure developed by the engine in the air intake region. An additional fuel-/air mixture which is accounted for by the tank venting therefore results also if the regeneration of the intermediate storage is permitted only for specific operating conditions. This fuel/air mixture is not measured or cannot be measured with a reasonable effort and falsifies the fuel metering signal which is normally very exactly determined with a high computation effort. This fuel metering signal can be an injection control command $t_i$ for a fuel injection apparatus or a positioning current associated with a system for continuous fuel injection. The foregoing causes the fuel/air mixture to falsify the fuel quantity supplied to the engine.

This means that for specific angles of the throttle flap, the lambda value can be very substantially influenced by the fuel flows from the tank venting. The tank venting therefore creates problems also if the influence of this disturbing quantity is referred to the intake pipe pressure developed by the engine by means of pneumatic positioning members or if one completely excludes the application of the tank venting mixture by means of an electronic control for especially sensitive operating conditions such as idle. The tank venting operation becomes especially questionable if the fuel metering system is a so-called learning system. The purpose of such a learning, adaptive injection system is not to control out relatively constant disturbing quantities (idle carbon monoxide, elevation errors, leakage air errors and the like) by means of conventionally available lambda controls; instead, these disturbing quantities are to be correctly precontrolled immediately with the aid of learned correction values. The basis for such a precontrol comprises that the average long-term deviation of the lambda integrator values from the neutral value $\lambda=1$ is recognized and precontrolled quantities are adaptively so changed that a compensation of the disturbing quantities is possible. The long-term deviation is caused by specific disturbing quantities.

If the occurrence of an additional disturbance is traced to the undefined mixture of a tank venting apparatus which vents into the intake path of the engine, then the learning functions of the adaptive lambda precontrol must be turned off so that the precontrol quantities which have already been adapted and which are valid for normal operation without tank venting cannot be again falsified.

In this connection, there are two requirements which must be fulfilled. The adaptation (the learning of the drifts) must be repeatedly updated which in most instances can be done by means of adaptation with global (multiplicative) or structural (additive) operating factors. In special cases, adaptive learning characteristic fields are superposed on basic characteristic fields or the disturbing quantities (leakage air, elevation errors) must be learned out, for example, by systems which continuously meter or inject fuel. These disturbing quantities become manifest as offset or slope errors at the initial line $\lambda=1$.

The above-mentioned injection systems are so-called K-systems wherein a continuously injecting valve is precontrolled mechanically with respect to its base load by an air quantity meter and is corrected by means of a special positioning current originating at the lambda control.

On the other hand, the tank venting in the operationally warm condition may not be closed for a longer period of time. Usually, this leads to a known time control wherein adaptation takes place for blocked tank venting in alternation with the inhibition of learning in the presence of tank venting.

In a practical realization, it has been shown that the disturbing influence caused by the tank venting can be so large that it brings the active lambda control out of its control region for the two operating conditions of open and closed tank venting. That is, it permits operation at its one stop (rich) and this perhaps over a very long time span. Such a performance then makes necessary the introduction of one or more corrective values which return the control loop to $\lambda=1$ and is therefore complex.

These considerations led to the solution disclosed in U.S. Pat. No. 4,683,861 of comparatively complex adaptive precontrol corrections for which the disturbing quantities were detected only below the load region by means of mean-value formation of the lambda controller and it was attempted to hold the percentage error constant with a precontrol characteristic field for the opening cross section of a tank venting valve. The learning value is weakened by means of a factor above this load threshold. The learn value has two stops at which the opening cross section of the tank venting valve or the time control for the performance of the base adaptation/tank venting is changed when these stops are reached. If no learning region is active, then the learned value is again unlearned over a certain time with a so-called forgetting factor. In addition, control conditions exist which act upon the control at several locations and include several time constants.

SUMMARY OF THE INVENTION

In contrast to the foregoing, it is an object of the invention to provide a simple compensation of the tank venting error in a learning system such that no discontinuities are introduced thereby into the mixture and to prevent the occurrence of the disadvantage that the lambda controller runs out of its control region when the tank venting is open.

The invention affords the advantage that the tank venting disturbance quantities can be satisfactorily compensated for by means of learning values of the lambda control since the error influences which are in question can be corrected by means of the learning algorithm which includes additive and multiplicative adaptation values. This is the case especially where a learning K-system is concerned wherein the initial line $\lambda=1$ can be corrected, the initial line $\lambda=1$ being disturbed by the rotation and displacement at the zero point and at the slope.

The adaptive lambda control remains active also during the tank venting phases and learns out the disturbance quantities by means of the switching being undertaken between the suitably stored learn values for the basic adaptation and for the adaptation with tank venting. The switching is matched to the alternating opening and closing of the tank venting. Stated otherwise, the lambda control works in both operating situations with adaptive precontrol. The lambda control, however, uses different memories for the adaptively determined learn values so that with a transfer from base adaptation (no tank venting) to the operating condition of tank venting there is a transfer immediately to other precontrol values for correcting the disturbing influences or disturbing quantities which now occur. The above-mentioned learn values are for the zero point and slope in a continuously injecting system (K-system).

It is especially advantageous to take over the last learn value of a phase as the beginning value of the next phase so that only continuous transitions are obtained in the switching of the conventionally provided time control for the tank venting. These continuous transitions are then without jumps in the lambda value.

It is further advantageous that the lambda control learns out the tank venting disturbance quantity without a new program having to be set up. The lambda control remains actively adaptive also during the tank venting phase. It is only required that the learn values are provided in duplicate quantities in a memory which is preferably a resident RAM and to provide several software switches in the program sequence for the lambda adaptation. In this way, a substantially better guidance of the fuel/air mixture is achieved close to the desired lambda value without jumps and without the necessity that the adaptive performance of the lambda control must be alternately switched out continuously. The above-mentioned guidance of the fuel/air mixture can be obtained with adaptive precontrol quantities.

BRIEF DESCRIPTION OF THE DRAWING

The invention will now be described with reference to the drawing wherein.

DESCRIPTION OF THE PREFERRED EMBODIMENTS OF THE INVENTION

Figure 1:
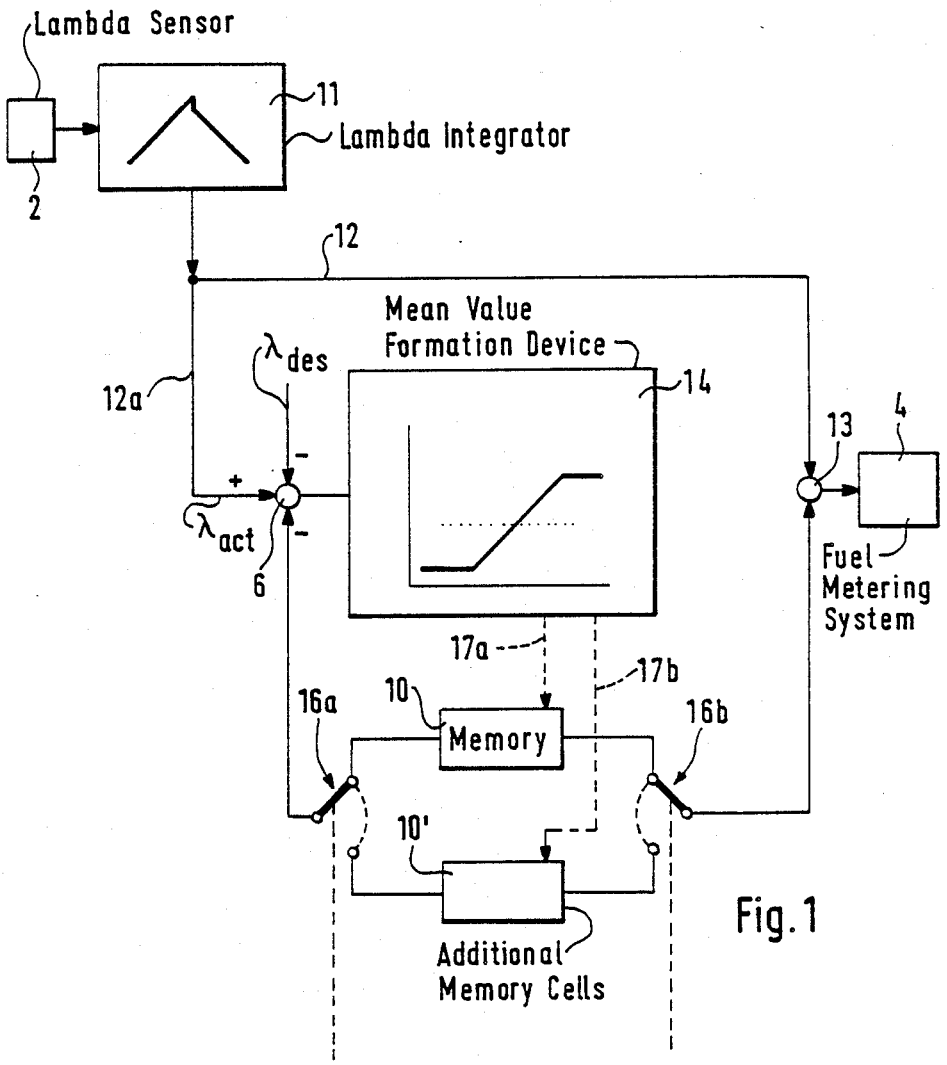
FIG. 1 shows a schematic block diagram of an embodiment of the arrangement according to the invention.

The basic idea of the invention is that even when an opening command is applied to a tank venting valve from a time control, the lambda control loop remains closed and learning continues. When this opening command is made, additional fuel reaches the air intake channel of the engine and with this opening command, there is a switching over to other correction values. In this connection, only basic adaptation values are not changed which are determined during adaptive learning without tank venting as precontrol quantities. In contrast, new correction values are formed and applied in the tank venting phases for precontrol for correcting the fuel/air mixture supplied to the engine.

The invention has a preferred application to such mixture-forming arrangements which continuously supply fuel to the engine especially by means of injection and are known commercially as K-Jetronic and KE-Jetronic developed by Robert Bosch GmbH. The basic idea of the invention to continue with the adaptive learning also during tank venting and to take other corrective values as a basis and to store the same can also be applied to such mixture-forming systems which operate with characteristic fields which in part have to be interpolated. The systems further superpose structural fields onto the last-mentioned characteristic fields for obtaining additive corrective values or they superpose global factors to obtain multiplicative corrective values by the learning process. With such continuously injecting systems which are in the following designated as K-systems for the metering of fuel to the engine, it is conventional to provide an actuator which is configured as a valve for continuously injecting fuel and is adjusted with respect to its base load by an air quantity measuring device an into which corrective quantities are introduced by generating an actuating current in the region of the lambda control. This actuating current determines the opening cross section of the continuously injecting valve in a supplementary manner and provides that the lambda control makes the initial line correspond with the value $\lambda=1$. This initial line describes the dependence of the fuel mass directed to the engine from the air mass. Disturbing quantities conventionally occur here and lead to a slope error or an offset error in the initial line and are compensated by means of the learning system of the adaptive precontrol in that additional correcting currents are applied to the actuator current generated by the lambda control which are designated as learning values for the compensation of the slope and offset errors and have a multiplicative or additive character with respect to the formation of the mixture. The above-mentioned disturbance quantities can include elevation errors or leakage air which lead to a slope error or an offset error in the initial line. Accordingly, in a K-system, only two learn values result which as corrective quantities can be stored for example in a buffered RAM for the multiplicative and additive correction. These corrective quantities are changeable adaptively during operation of the engine.

In the drawing, reference numeral 10 designates the memory for receiving the learn values of the base adaptation. The memory can be configured as a buffered RAM and includes further memory cells 10' which receive the learn values which result during continuous adaptation when the tank venting takes place.

The lambda controller shown in FIG. 1 supplies a fuel metering system represented by block 4.

The basic function logic operation is such that a lambda integrator 11 simultaneously drives a mean-value formation device 14 via the output lead 12*a*. The lambda integrator 11 is supplied by a lambda sensor 2 and is connected via a first output lead 12 directly to a summation point 13 for forming the total correction current (actuator current for a K-system or in another manner–translatable into the time-dependent measurement of the injection pulses $t_i$) This mean-value formation device 14 as a feedback coupled integrator generates a lambda mean value and directs this mean value separately for the two different operating conditions of the engine to the memory location 10 for the basic adaptation or the memory cells 10' for the adaptation with tank venting. The feedback coupled integrator corresponds to a time discrete low pass function when applied to a program-controlled microprocessor or computer.

Reference numeral 15 indicates a time-dependent sequence which shows the basic adaptation phases in alternating sequence with the tank venting adaptation phases. To match with this time control, switches (16*a*, 16*b*) are assigned to the memory units (10, 10'). The switches (16*a*, 16*b*) are matched to the alternating time control (basic adaptation/tank venting adaptation) in a corresponding manner to switch the memory cells for the basic adaptation or for the adaptation with tank venting as precontrol values on the lambda control. These switches (16*a*, 16*b*) are preferably software switches which are set in correspondence to the basic adaptation/tank venting adaptation by means of the time control. In the same manner, the switching of the output values resulting at the mean-value formation device 14 is achieved via the two connecting lines (17*a*, 17*b*) to the memory cells in correspondence to the time control logic operation with the learn values for the basic adaptation as base values not being changed with the transitions between the individual phases since these learn values must again be taken as a basis after the engine is shut off and later set in operation again and also for several control conditions.

Accordingly, a lambda correction with adaptive precontrol values for open as well as closed tank venting is possible from the memory cells with continuous transitions (without jumps in the particular lambda values) being achieved at the instant of switching of the time control in that the RAM cells taken here as a basis for the basic adaptation (without tank venting) and adaptation with tank venting can simply be stored again, that is, the last learn value of one phase is simultaneously the initial value of the next phase.

In addition, it is possible to change the time constant of the control loop for the long-term basic adaptation as required for the disturbing quantity which is to be rapidly regulated out as required; that is, to likewise switch to another value via appropriately controlled software switches. The above-mentioned long-term basic adaptation functions to compensate for the disturbing quantities introduced by leakage air and elevation errors primarily in the K-systems which are discussed herein.

Finally, in the region of the time control, it can be an advantage if a third phase or a so-called quieting phase is switched in between either only in the transition from tank venting to base adaptation or in the transition of each phase to the other. In this third phase and when there is a transition from the tank venting phase to the base adaptation phase, the tank venting is already closed; however, no switchover to the base adaptation has yet resulted. Stated otherwise, the learn values of the adaptation phase with tank venting begin to change in a direction of the learn values of the base adaptation so that when the switchover is made, either jumps no longer occur or the jumps are eliminated by means of taking along the last learn value of the one phase as the initial value of the next phase.

It is recommended to provide in the region of the base adaptation two additional memory cells which contain adaptively learned correction values of the base adaptation and which are applied in the first startup of the engine. In this case, transition jumps are prevented by restoring the RAM-cells with and without tank venting in the continuous operational process.

Figure 2:
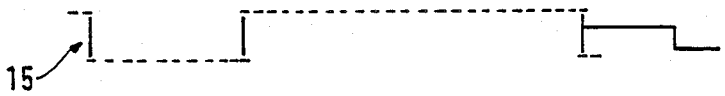
FIG. 2 is a waveform which shows the time-dependent sequence of the basic adaptation phases in alternation with the tank venting adaptation phases.

Two flow diagrams are provided because the subject matter of the invention can operate in the basic adaptation phase or in the tank ventilation phase. More specifically, the invention remains within one phase and after a predetermined time has run as indicated by the waveform shown in FIG. 2, the apparatus switches over to the second phase. A second phase diagram identified at FIG. 4 attached hereto describes the phase change.

Figure 3:
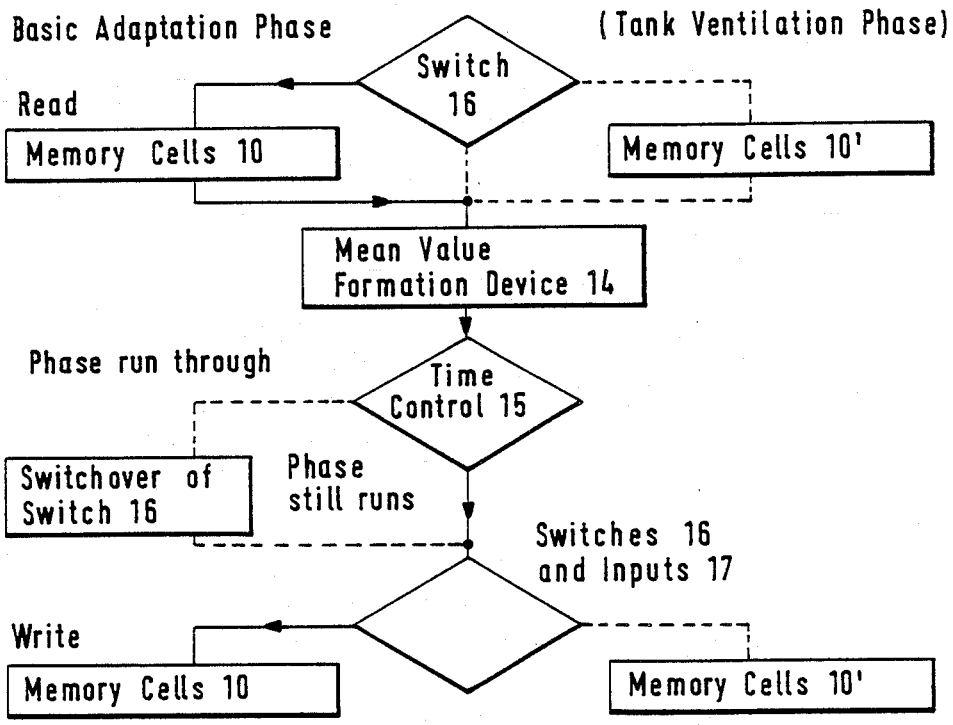
FIG. 3 is a flow diagram showing the basic adaptation phase (I) and the tank ventilation phase (I'); and, FIG. 4 is a phase change diagram indicating the change from basic adaptation phase to tank ventilation phase.

The flow diagram shown in FIG. 3 is identified as (I, I') with the phase I being the basic adaptation phase and the phase I' being the tank ventilation phase with the latter being indicated by dashed lines.

The double switch (16*a*, 16*b*) is identified in the flow diagram with reference numeral 16. As described above, reference numeral 15 indicates a time-dependent sequence which shows the basic adaptation phase in alternating sequence with the tank venting adaption phases. To match this time control, switches, (16*a*, 16*b*) are assigned to memory units (10, 10'). The switches (16*a*, 16*b*) are matched to the alternating time control (basic adaptation/tank venting adaptation) in a corresponding manner switch the memory cells for the basic adaptation or for the adaptation with tank venting as precontrol values on the lambda control. Thus, when the apparatus is in the basic adaptation phase, precontrol values are transmitted through switch 16*a* in the position thereof shown to the summation point 6 directly to the left of mean value formation device 14. A minus sign is shown here because this precontrol value is subtracted with the subtraction being needed because the precontrol value is also added at the output summation point 13 and superimposed on the normal lambda control which takes place via line 12.

A similar situation occurs during the tank venting phase when the switching means (16*a*, 16*b*) are switched so that memory 10' is connected. In this case, precontrol values which consider tank venting are subtracted and superposed as described above.

The flow diagram (I, I') of FIG. 3 shows that the switch 16 switches to the particular memory cells 10 or 10' as required. The basic function is such that the switch 16 is switched to the memory cells 10 for the basic adaptation phase whereas, for the tank ventilation phase, the switch 16 is switched to storage cells 10'. The signal from the lambda integrator 11 is supplied directly to the mean value formation device 14 via the summing point 6 so that for this switching position within the phase, the precontrol quantities are read out of the storage cells 10 and are supplied to the mean value formation device 14. Via connecting lines 17, the new data formed in the particular phase are read into the corresponding memory cells as indicated in the flow diagram and in FIG. 1 by the dashed lines 17.

Figure 4:
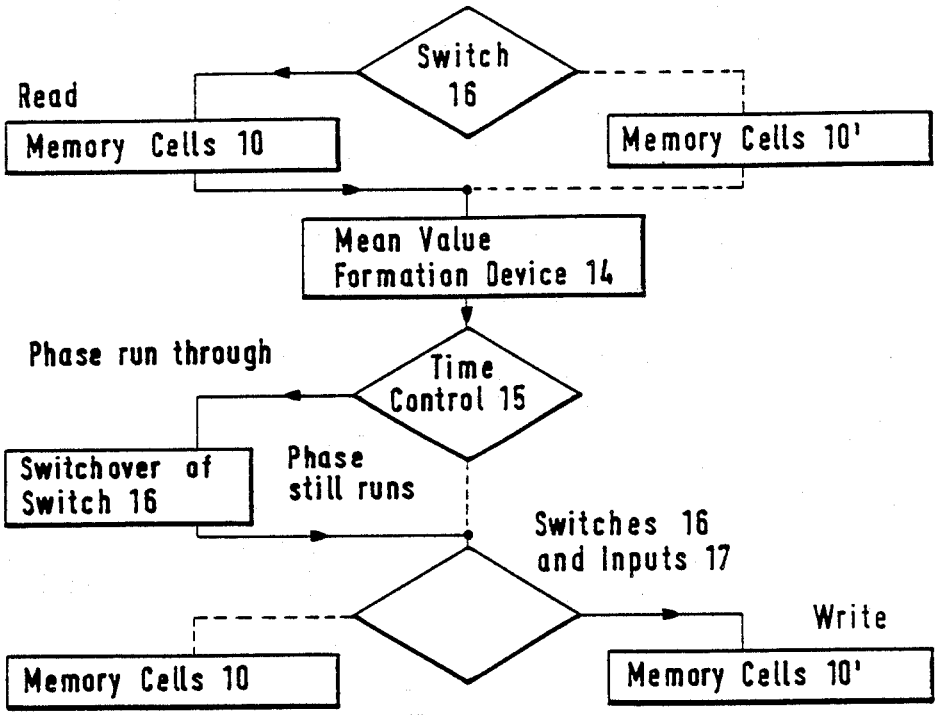

The apparatus operated pursuant to flow diagram of FIG. 4 when there is a transition from one phase to the other such a from the basic adaptation phase into the tank ventilation phase. In this case, the time control 15 determines that the basic adaptation phase has run its course and that the switch 16 switches as required by the time control 15 and connects to the memory cells 10' into which date is read via switch means 16 and input line 17 in order to take along the last learned value of the basic adaptation phase which can then be the initial value of the next phase. At the instant of the phase change, data is read into the memory cells 10' as described and immediately after a completed phase change, the flow diagram of FIG. 3 applies with the sequence for the tank ventilation phase I' being applicable. The computer then works with the data in memory cells 10' which relate to the tank ventilation phase and also writes into these cells new values corrected in correspondence to the learning process for which the mean-value formation device 14 is utilized.

It is understood that the foregoing description is that of the preferred embodiments of the invention and that various changes and modifications may be made thereto without departing from the spirit and scope of the invention as defined in the appended claims.

What is claimed is:

1. Method for compensating for a tank venting error occurring in an adaptive learning system for metering the required fuel quantity to an internal combustion engine, the method comprising the steps of:

determining said fuel quantity by means of a closed loop control wherein an actual value is evaluated (lambda control) and wherein open loop precontrol quantities stored in a first memory are taken as a basis which are also corrected by means of an adaptive learning process likewise using said actual value in an averaged form supplying a fuel flow to the intake region of the engine supplementary to said metered fuel quantity, said fuel flow resulting from an intermediate container (active charcoal filter) which takes up fuel vapor from the tank to thereby regenerate said container;

switching over between closed tank venting and open tank venting phases, the latter leading to the supplementary fuel flow while at the same time maintaining the adaptive learning from lambda control for both operating conditions in such a manner that second precontrol quantities are established which are related to the disturbing quantities occurring during said open tank venting;

storing said second precontrol quantities in a separate memory function; and, switching between the respective stored learned values for each change between basic adaptation phase and tank venting adaptation phase.

2. The method of claim 1, wherein a system is used as a basis which is continuously metering the required fuel quantity to the engine for which the lambda control includes two learn values for slope correction and for base point correction of the initial line ($\lambda=1$) as a multiplicative and additive corrective value, said initial line describing the dependence of the fuel quantity on the air mass flow; and, wherein said learn values for slope error and offset error are read into a memory (buffered RAM) in double quantity for the basic adaptation phase and the tank venting phase, said learn values being newly prepared by means of the adaptive learn process; and, wherein the particular memory cells are switched over in dependence upon a time control of the tank venting phase and base adaptation phase.

3. The method of claim 1, wherein the last learn value of a given phase is taken as the initial value for the next phase for obtaining a continuous transition without jumps at the instant of switchover of the time control between basic adaptation and tank venting adaptation.

4. The method of claim 1, wherein the basic adaptation values, which are the learn values when tank venting is closed, remain unchanged for utilization as precontrol correction values after the engine is switched off and again placed into service.

5. The method of claim !, wherein the time constants of the control loop of the long-term basic adaptation for the disturbance quantity which is to be regulated out are likewise switched over together with the switchover between the learn values in the particular memory basis adaptation and adaptation with tank venting.

6. Apparatus for compensating for a tank venting error in an adaptive learning system for metering the required fuel quantity to an internal combustion engine, the apparatus comprising:

means for determining said fuel quantity by means of a closed loop control wherein an actual value is evaluated (lambda control) and wherein open loop precontrol quantities stored in a first memory are taken as a basis which are also corrected by means of an adaptive learning process likewise using said actual value in an averaged form;

means for supplying a fuel flow to the intake region of the engine supplementary to said metered fuel quantity, said flow resulting from an intermediate container which takes up fuel vapor from the tank to thereby regenerate said container;

first switching means for switching over between closed tank venting and open tank venting phases, the latter leading to the supplementary fuel flow while at the sale time maintaining the adaptive learning from lambda control for both operating conditions in such a manner that second precontrol quantities are established which are related to the disturbing quantities occurring during said open tank venting;

memory means for storing said second precontrol quantities in a separate memory function;

second switching means for switching between respective stored learned values for each change between basic adaptation phase and tank venting adaptation phase;

said memory means including a double number of cells receiving the learn values of the adaptive precontrol;

means for generating adaptive precontrol values while retaining the adaptive precontrol also during the tank venting;

said memory including means for storing said adaptive precontrol values separate to said learn values of the basic adaptation; and, third switching means for switching between the second adaptive precontrol values in the separate memory cells in dependence upon the time control determining the sequence of the basis adaptation phases and the tank venting phases.

7. The apparatus of claim 6, said memory means being a buffered RAM.

* * * * *